United States Patent [19]

White

[11] 4,368,892

[45] Jan. 18, 1983

[54] SWAT BALL GAME APPARATUS

[76] Inventor: William P. White, Rte. 2, Box 16A, Wedowee, Ala. 36278

[21] Appl. No.: 305,705

[22] Filed: Sep. 25, 1981

[51] Int. Cl.[3] ..... A63B 71/02

[52] U.S. Cl. ..... 273/411

[58] Field of Search ..... 273/411, 340, 342, 338

[56] References Cited

U.S. PATENT DOCUMENTS

| | | | |
|---|---|---|---|
| 1,556,046 | 10/1925 | Taylor | 273/411 |
| 2,822,176 | 2/1958 | Robes | 273/411 X |
| 2,823,034 | 2/1958 | Bingham, Jr. | 273/411 |
| 3,393,913 | 7/1968 | Safina | 273/411 X |
| 3,968,968 | 7/1976 | Peterson | 273/411 |
| 4,146,225 | 3/1979 | Hallett et al. | 273/342 |
| 4,180,266 | 12/1979 | Morin et al. | 273/338 |

*Primary Examiner*—William H. Grieb

*Attorney, Agent, or Firm*—Witherspoon & Hargest

[57] ABSTRACT

Apparatus for use in playing a hand swat ball game, the apparatus including four upstanding end court supports forming the four corners of a rectangular playing court where the length is twice the width. A pair of upstanding mid court supports divides the playing court into two equal and square playing areas. A backboard is affixed to the tops of the six supports and is generally coextensive therewith. A ricochet bar extends between each pair of end and mid court supports. An end ricochet bar extends between each pair of end court supports. A center ricochet bar extends between the pair of mid court supports. All ricochet bars are equispaced downwardly from the backboard. With at least one player in each playing area, a player in a first play area serves the ball by striking it by hand to drive the ball through a fair play zone into the second play area. The fair play zone is defined by the area surrounded by the center ricochet bar, the backboard and contiguous portions of the mid court supports. The second player in the second play area returns the ball through the fair play zone into the first play area.

3 Claims, 2 Drawing Figures

SWAT BALL GAME APPARATUS

BACKGROUND AND OBJECTS OF THE INVENTION

This invention relates to a swat ball game and apparatus therefor and more particularly a swat ball game wherein players in opposing first and second playing areas strike a ball by hand from a first playing area through a fair play zone to a second and opposite playing area where the player therein without catching the ball and before it touches the playing area floor strikes it with his hand or hands to direct it through the fair play zone back into the first playing area.

Now, perhaps, more than ever there is a need for games which provide enjoyment, serve as a good mode of exercise, are of the type where one may develop skill at such game and also are moderate from an apparatus cost standpoint.

In view of the foregoing it is an object of this invention to provide a ball type game which serves to develop a high degree of muscle activity.

It is another object of this invention to provide a ball type game wherein two or more people may participate to develop skill with respect to the game parameters.

It is still another object to provide a swat ball game wherein the apparatus required is inexpensive, and upkeep and maintenance are almost negligible.

It is a further object of this invention to provide apparatus for a swat ball game wherein the apparatus is easily assembled.

The above objects and advantages will become more apparent when taken in conjunction with the following detailed description and drawings showing by way of example one preferred embodiment of this invention.

IN THE DRAWINGS

FIG. 1 is a perspective view of the apparatus used in the present invention, and FIG. 2 is a perspective view of the apparatus of this invention with the backboard removed to better show the playing area.

DETAILED DESCRIPTION

Figure 1:
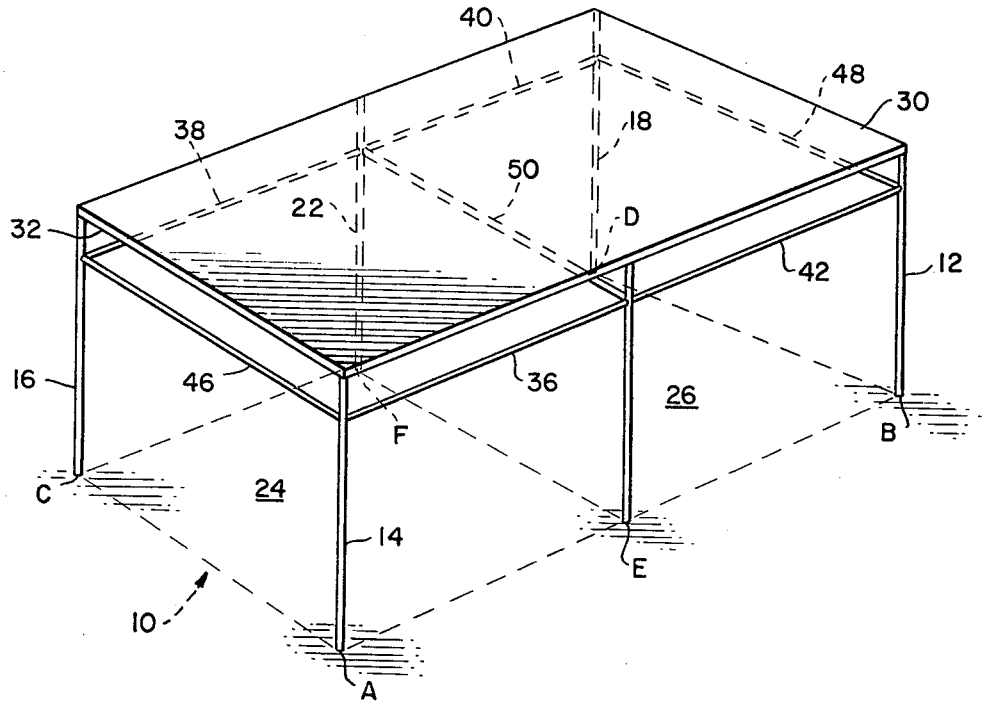
Figure 2:
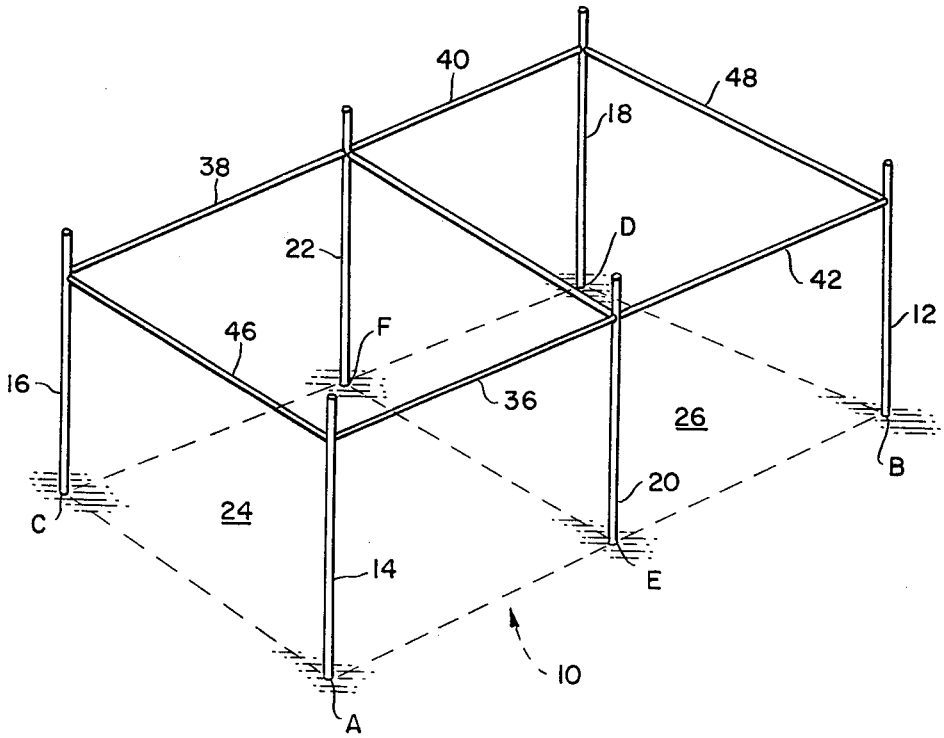

Referring to the two Figures of the drawings, the swat ball apparatus 10 comprises four upstanding end court supports 12, 14, 16 and 18 to form the four corners of a rectangular playing court A B C D wherein the length A B is twice the width A C. In actual practice the length A B is twenty-two feet while the width is eleven feet.

A pair of upstanding mid-court supports 20 and 22 are positioned mid way between end court supports 12 and 14, and end court supports 16 and 18 respectively thereby dividing the playing court into two equal square playing areas 24 and 26. Playing area 24 is defined by points A C F E and playing area 26 is defined by points E B D F. In view of the foregoing, it should be obvious that each playing area is 11 feet by 11 feet. The playing floor comprising the two playing areas should be reasonably smooth and level.

A backboard 30 is affixed to the tops of the six supports 14, 20, 12, 16, 22 and 18 and is generally coextensive therewith. The six supports are vertically adjustable to adjust the height of the backboard above the playing areas. The backboard 30 should be made of material to provide requisite strength to form a smooth and even playing surface 32 on the underside of the backboard 30 so that the ball will bounce off the backboard in a reasonably consistent manner. A side ricochet bar 36 is connected between end court support 14 and mid court support 20. Similarly, side ricochet bar 38 is positioned between end court support 16 and mid court support 22; side ricochet bar 40 is held between end court support 18 and mid court support 22, while side ricochet bar 42 is positioned between end court support 12 and mid court support 20. It should be noted that all side ricochet bars are spaced downwardly from the backboard 30 and parallel thereto.

An end ricochet bar 46 extends between end court supports 14 and 16 while end ricochet bar 48 extends between end court supports 12 and 18. It should be noted that these ricochet bars 46 and 48 are aligned with the side ricochet bars. A center ricochet bar 50 is positioned between mid court support 20 and mid court support 22 and is spaced downwardly from the backboard 30 by the same distance as the other ricochet bars.

One of the most important areas in the game apparatus is the first play zone defined by the center ricochet bar 50, the bottom 32 of the backboard 30 and the two contigious portions of the mid court supports 20 and 22.

As previously set forth, play area 24 is defined by points A C F E and play area 26 is defined by B E F D. The serve line for play area 24 is the line formed by A C and the serve line for play area 26 is line B D.

The game is played by two or more persons equally divided on opposite sides of the center ricochet bar 50. The ball is served to the other side by a player standing behind the serve line A C and striking the ball with his hand so as to direct it through the fair play zone and into the other playing area 26. The ball must be directed so that if not touched it would fall within the confines of the play area receiving the ball. Players must strike or swat the ball with their open hands. In serving, if the ball strikes the center ricochet bar 50 the serve is repeated whether it was in or out of bounds. Upon a serve being in, the receiving party must strike the ball and direct it through the fair play zone and keep the ball within the defined playing area. Such back and forth action continues until someone makes an error by hitting the ball out of bounds or not getting it through the fair play zone. The server is allowed two serves to get the ball in play, if he does not succeed the ball goes to other side for service and such side is awarded one point. The server continues to serve as long as his side does not make an error. Eleven points define a game. However that winner must be two points ahead to win, otherwise play continues until one side is two points ahead with a total of eleven or more.

There are many basic rules specified to assure a smooth and fair game such as when playing doubles no player on the same team may hit the ball two times straight unless the ball hits a ricochet bar, no player may catch the ball, when the ball is returned to a point outside the play area the point is lost, and players may not touch the ricochet bars.

At this point it would appear that the sole purpose of the backboard 30 is to define the fair play zone and to limit height of ball travel. One of the exciting aspects of the game is the use of the backboard to bounce shots to the other team. This is probably one of the most interesting features as it makes possible a much faster and trickier game.

Rules for conducting the instant swat ball game may be varied considerably to meet the needs and desires of the players. The main feature of the game is the fair play zone in combination with the backboard which makes possible the bouncing of the ball thereagainst to speed up the game but adding a totally new dimension thereto.

One of the type of balls successfully used in this game is one sold by Parker Brothers and known as the Nerf ball.

What is claimed is:

1. Apparatus for use in playing a hand swat ball game, said apparatus comprising in combination, four upstanding end court supports to form the four corners of a rectangular playing court, a pair of upstanding mid court supports, each one of the pair bisecting the lengthwise side of the playing court thereby dividing the playing court into two equal playing areas, a backboard affixed to the top ends of the six supports and generally coextensive therewith, a center ricochet bar positioned between the pair of mid court supports, said center ricochet bar being spaced from and parallel to the backboard, said playing court being flat and parallel to the backboard whereby with at least one player in each of the two playing areas, a player in a first area strikes the swat ball with his hand and directs it through a fair play zone defined by the backboard, the center ricochet bar and contiguous portions of the mid court supports, and into a second playing area, so that the other player may strike the ball so that it will pass through the fair play zone and into the first playing area, play on both sides to be restricted to the first and second playing areas.

2. Apparatus for use in playing a hand swat ball game, said apparatus comprising in combination, four upstanding end court supports to form the four corners of a rectangular playing court where the length is equal to twice the width, a pair of upstanding mid court supports, each one of the pair bisecting the lengthwise side of the playing court mid court thereby dividing the playing court into two equal square playing areas, a backboard affixed to the top ends of the six supports and generally coextensive therewith, a ricochet bar extending between each pair of end and mid court supports, said bars being equi-spaced downwardly of and parallel to the backboard, two end ricochet bars, one extending between each continguous pair of end court supports, said end ricochet bars being spaced from and parallel to the backboard the same distance as the side ricochet bars, a center ricochet bar positioned between the pair of mid court supports, said center ricochet bar being spaced from and parallel to the backboard the same distance as the side ricochet bars, said playing court being flat and parallel to the backboard, whereby with at least one player in each of the two playing areas, a player in a first area strikes the swat ball with his hand and directs it through a fair play zone defined by the backboard, the center ricochet bar and contiguous portions of the mid court supports, and into a second playing area, so that the other player may strike the ball so that it will pass through the fair play zone and into the first playing area, play on both sides to be restricted to the first and second playing areas.

3. The invention as set forth in claim 2 and wherein the four end court supports and the two mid court supports are vertically adjustable to adjust the height of the backboard above the playing areas.

* * * * *